United States Patent [19]

Van Doren

[11] 4,275,636

[45] Jun. 30, 1981

[54] TIES FOR THE MOUTHPIECE OF A WIND INSTRUMENT

[75] Inventor: Bernard M. Van Doren, Saint Germain En Laye, France

[73] Assignee: Ets Van Doren, France

[21] Appl. No.: 43,510

[22] Filed: May 29, 1979

[30] Foreign Application Priority Data

Oct. 3, 1978 [FR] France ..... 78 28230

[51] Int. Cl.[3] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 3,618,440 | 11/1971 | Ratterree | 84/383 R |
| 3,890,873 | 6/1975 | Harrison | 84/383 R |
| 4,080,866 | 3/1978 | Toof | 84/383 R |

*Primary Examiner*—Lawrence R. Franklin

*Attorney, Agent, or Firm*—Scully, Scott, Murphy & Presser

[57] ABSTRACT

The invention relates to a flexible tie made from a deformable material, for the mouthpiece of a wind instrument, comprising two split ring-shaped parts, disposed respectively in a plane perpendicular to the axis of the tie and fitted with assembly means capable of drawing together their opposing ends.

According to the invention, each ring comprises, on its internal face, perpendicularly to the axis of the tie, a curvilinear projecting part capable of contacting the external convex part of the reed of a wind instrument fitted with this tie, when said rings are deformed under the action of said assembly means.

This tie maintains the reed in position on the mouthpiece without affecting adversely its vibrations.

7 Claims, 3 Drawing Figures

TIES FOR THE MOUTHPIECE OF A WIND INSTRUMENT

The invention relates to ties for the mouthpiece of wind instruments.

It is known that, in such instruments as the clarinet or the saxophone, the reed is held in place on the mouthpiece of the instrument by a collar, called tie, which corresponds to the general shape of the mouthpiece and bears against the convex external face of the reed, whereas the flat face thereof is in contact with a flat part of the mouthpiece.

The tie is split along one of its generatrices and assembly means such as screws and threaded bores are provided on the two opposing parts, to interlock them and thus cause a tightening action on the reed.

Ties of a known type have however the disadvantage of exerting on the reed a tightening force which is not distributed homogeneously, which has an adverse effect on the vibrations of the reed and is prejudicial to the tone of the instrument.

Moreover, excessive strain may be placed by the tie on the shank of the mouthpiece and distort it.

These disadvantages of known ties are due to their very structure. In fact:

the tie has a tubular perforated form and bears over a large area on the whole of the base of the reed as well as on the mouthpiece of the instrument;

the tie is made from a rigid material and consequently cannot be deformed, under the action of the clamping screws, to correspond perfectly and flexibly to the form of the reed and of the mouthpiece;

the clamping strain of the screws is not transmitted gradually to the tie and there may result a distortion thereof.

The invention has as an aim to remove these defects of the ties of the prior art, by proposing a tie which holds the reed in place without being prejudicial to the vibrations, without deforming the mouthpiece of the instrument and without having an adverse effect on the musical qualities thereof.

To this purpose, the invention provides a flexible tie, made from a deformable material, for the mouthpiece of a wind instrument, comprising two split ring-shaped parts, disposed respectively in a plane perpendicular to the axis of the tie and fitted with assembly means capable of drawing together their opposed ends, this tie being characterized in that each of said rings comprises, on its internal face, perpendicularly to the axis of the tie, a projecting curvilinear part capable of contacting said external convex part of the reed of a wind instrument fitted with this tie, when said rings are deformed under the action of said assembly means.

It is thus solely through the projecting parts of the internal face of said rings that the tie is in contact with the reed of the wind instrument. For each ring, this contact is thus made in a plane perpendicular to the flat face of the reed, along a line which takes on the exact shape of the external convex surface of the base of the reed. Thus, the clamping strains imposed on the reed by the means for assembling the tie are distributed homogeneously over the whole base of the reed, without excessive pressure at certain points.

So as to limit the contact area between the tie, on the one hand, the reed and the mouthpiece of the instrument, on the other hand, the two rings of the tie will be preferably connected transversely by rectilinear parts forming braces, to the exclusion of any other connecting member.

The assembly means of the tie may comprise, in a known way, screws engaged respectively in a projection at one end of a ring and cooperating with a nut at the other end, but, so that the clamping strain is gradually exerted on the rings, the projection and the associated part of the screw will preferably have a conical profile.

The accompanying drawings illustrate an embodiment of a tie in accordance with the invention, which will be described hereafter in greater detail. In these drawings.

Figure 3:
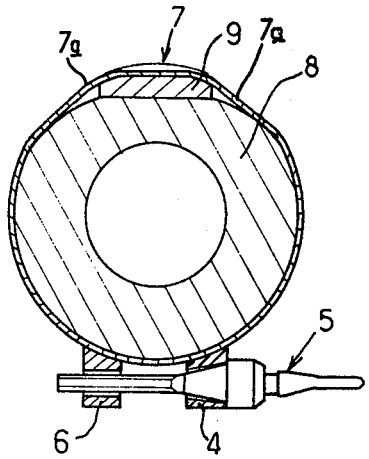
FIG. 3 is a cross-section, at the level of a ring, of the tie fitted to the mouthpiece of the clarinet.

The tie shown comprises essentially two split rings 1 and 2, connected transversely by braces 3. The ends of rings 1 and 2 are provided respectively with a projection 4, in which may be engaged a clamping screw 5 and a nut 6 cooperating with this screw.

Each ring 1 and 2 comprises, on a portion of its internal face, a projecting curvilinear part 7, provided by stamping for example. Before fitting, rings 1 and 2 have a circular shape.

Figure 2:
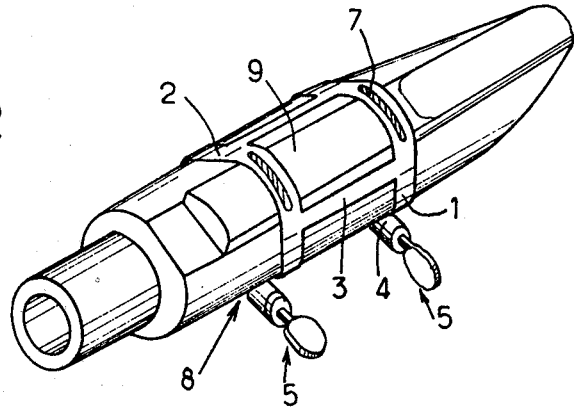
FIG. 2 is a perspective view of the tie fitted to the mouthpiece of a clarinet.

As shown in FIGS. 2 and 3, the tie is intended to a be fitted to the shank of the mouthpiece 8 of a wind instrument and to hold a reed 9 in place thereon. For this purpose, the tie surrounds mouthpiece 8, whose form it assumes, and contacts through the projecting parts 7 the external convex face of the reed.

The tie is made from an alloy such as maillechort or from a plastic material, and the thickness of the rings is sufficiently small for them to be deformed manually by exerting a pull on the opposing parts of the split rings.

When the clamping screws 5 are engaged in the projections 4 and screwed into nuts 6, rings 1 and 2 are therefore deformed and the projecting parts 7 on their internal face come into contact, through their ridge, with the convex face of reed 9 and apply the flat face thereof against the corresponding flat face of mouthpiece 8, without exerting an excessive pressure on this mouthpiece or on the reed, but distributing homogeneously on the contrary the clamping pressure over these members. By their deformation under the action of screws 5, rings 1 and 2 lose the circular shape which they had originally and, as can be seen in FIG. 3, substantially rectilinear parts such as 7*a* connect the part applied against the convex face of the reed and the part in contact with the shank of the mouthpiece. This deformation of the rings is permanent and, after a first use, the tie therefore keeps the shape illustrated in FIGS. 2 and 3.

It will be noted that the tie is in contact with the reed 9 only through the projecting parts 7 of rings 1 and 2 and, with mouthpiece 8, only through rings 1 and 2 and braces 3.

So as to exert a progressive and well distributed clamping strain on rings 1 and 2, part 5*a* of the screws 5 engaged in the projections 4 has a conical profile and projections 4 comprise a recess having a complementary profile, as shown in FIG. 3.

Figure 1:
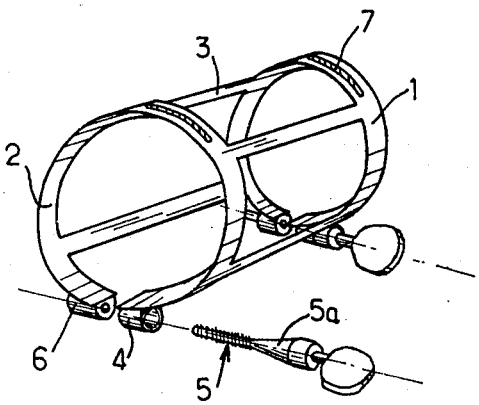
FIG. 1 is a perspective view of the tie before its first mounting on the mouthpiece of a wind instrument.

As can also be seen in FIG. 1, the tie in accordance with the invention has a light and flexible structure, which allows it to conform perfectly to the profile of the reed and the mouthpiece of the instrument.

What is claimed is:

1. A flexible tie made from a deformable material, for the mouthpiece of a wind instrument, comprising two split ring-shaped parts, disposed respectively in a plane perpendicular to the axis of the tie and fitted with assembly means capable of drawing together their opposing ends, said tie being characterized in that each of said rings comprises, on its internal face, perpendicularly to the axis of the tie, a projecting curvilinear, arcuate stamped part which contacts along all of its length the external convex part of the reed of a wind instrument fitted with the tie, when said rings are deformed under the action of said assembly means.

2. A tie according to claim 1, characterized in that it comprises no surface likely to contact said reed other than said projecting parts of the internal face of said rings.

3. A tie according to either of claims 1 or 2, characterized in that said rings are connected by rectilinear parts forming braces, to the exclusion of any other connecting member.

4. A flexible tie made from a deformable material, for the mouthpiece of a wind instrument, comprising two split ring-shaped parts, disposed respectively in a plane perpendicular to the axis of the tie and fitted with assembling means capable of drawing together their opposing ends, said means for assembling the ends of the split rings comprising screws engaged in a projection at one end of a ring and cooperating with a nut at the other end, this tie being characterized in that the part of the screws engaged in said projections and the associated part of said projections have a conical profile, said tie further being characterized in that each of said rings comprises, on its internal face, perpendicularly to the axis of the tie, a projecting curvilinear part capable of contacting the external convex part of the reed of a wind instrument fitted with the tie, when said rings are deformed under the action of said assembly means.

5. A flexible tie made from a deformable material, for the mouthpiece of a wind instrument, comprising two split ring-shaped parts, disposed respectively in a plane perpendicular to the axis of the tie and fitted with assembling means capable of drawing together their opposing ends, said means for assembling the ends of the split rings comprising screws engaged in a projection at one end of a ring and cooperating with a nut at the other end, this tie being characterized in that the part of the screws engaged in said projections and the associated part of said projections have a conical profile, said tie further being characterized in that each of said rings comprises, on its internal face, perpendicularly to the axis of the tie, a projecting curvilinear part capable of contacting the external convex part of the reed of a wind instrument fitted with the tie, when said rings are deformed under the action of said assembly means, said tie further having no surface likely to contact said reed other than said projecting parts of the internal face of said rings.

6. A flexible tie made from a deformable material, for the mouthpiece of a wind instrument, comprising two split ring-shaped parts, disposed respectively in a plane perpendicular to the axis of the tie and fitted with assembling means capable of drawing together their opposing ends, said means for assembling the ends of the split rings comprising screws engaged in a projection at one end of a ring and cooperating with a nut at the other end, said tie being characterized in that the part of the screws engaged in said projections and the associated part of said projections have a conical profile, said tie further being characterized in that each of said rings comprises, on its internal face, perpendicularly to the axis of the tie, a projecting curvilinear part capable of contacting the external convex part of the reed of a wind instrument fitted with the tie, when said rings are deformed under the action of said assembly means, said tie further having no surface likely to contact said reed other than said projecting parts of the internal face of said rings, and said rings being connected by rectilinear parts forming braces, to the exclusion of any other connecting member.

7. A flexible tie made from a deformable material, for the mouthpiece of a wind instrument, comprising two split ring-shaped parts, disposed respectively in a plane perpendicular to the axis of the tie and fitted with assembling means capable of drawing together their opposing ends, said means for assembling the ends of the split rings comprising screws engaged in a projection at one end of a ring and cooperating with a nut at the other end, said tie being characterized in that the part of the screws engaged in said projections and the associated part of said projections have a conical profile, said tie further being characterized in that each of said rings comprises, on its internal face, perpendicularly to the axis of the tie, a projecting curvilinear part capable of contacting the external convex part of the reed of a wind instrument fitted with the tie, when said rings are deformed under the action of said assembly means, and said rings being connected by rectilinear parts forming braces, to the exclusion of any other connecting member.

* * * * *